United States Patent [19]

Aoyama

[11] Patent Number: 4,549,054

[45] Date of Patent: Oct. 22, 1985

[54] MICROWAVE OVEN CONSTRUCTION HAVING SEPARATE COMPONENT RECEIVING CHAMBERS

[75] Inventor: Shuki Aoyama, Aichi, Japan

[73] Assignee: Tokyo Shibaura Denki Kabushiki Kaisha, Kawasaki, Japan

[21] Appl. No.: 541,912

[22] Filed: Oct. 14, 1983

[30] Foreign Application Priority Data

Oct. 18, 1982 [JP] Japan ..... 57-182535
Oct. 18, 1982 [JP] Japan ..... 57-182537
Oct. 18, 1982 [JP] Japan ..... 57-182539
Oct. 18, 1982 [JP] Japan ..... 57-182540

[51] Int. Cl.[4] ..... H05B 6/06

[52] U.S. Cl. ..... 219/10.55 R; 219/10.55 B; 219/10.55 F

[58] Field of Search ..... 219/10.55 R, 10.55 B, 219/10.55 F, 10.55 D, 10.55 E; 126/190, 273 A, 299; 312/296

[56] References Cited

U.S. PATENT DOCUMENTS 2,860,026 11/1958 Long ..... 312/296

FOREIGN PATENT DOCUMENTS 1615289 11/1967 Fed. Rep. of Germany .
3104677 8/1982 Fed. Rep. of Germany .

*Primary Examiner*—Roy N. Envall, Jr.

*Assistant Examiner*—M. M. Lateef

*Attorney, Agent, or Firm*—Cushman, Darby and Cushman

[57] ABSTRACT

An oven structure having an outer case and an inner case disposed within the outer case, both cases being substantially box-like in shape. The inner case positioned at a prescribed distance from an inner surface of the outer case, and defines a heating chamber for receiving foodstuffs to be cooked. A heat shielding plate is disposed inside of the outer case and oriented so as to oppose to a rear plate of the inner case with a prescribed interval therebetween. The shielding plate divides the space between the inner and outer cases into a first receiving chamber located at the side of a rear wall of the outer case and a second receiving chamber located at the side of the inner case. Heating elements are provided in the heating chamber. Each heating element has a heat generating portion located with in the heating chamber, and a pair of connecting portions attached to the rear plate. Each connecting portion extends into the first receiving chamber through the rear plate and shielding plate. In the first receiving chamber, a high frequency oscillator is provided for radiating high frequency energy into the heating chamber is disposed. In the second receiving chamber, there is provided a controlling device for controlling the operations of the heaters and the high frequency oscillator.

11 Claims, 7 Drawing Figures

MICROWAVE OVEN CONSTRUCTION HAVING SEPARATE COMPONENT RECEIVING CHAMBERS

BACKGROUND OF THE INVENTION

The present invention relates to a high-frequency heating device (microwave oven) for cooking of foodstuffs which are placed in a heating chamber, the heating and cooking operations being conducted by an electric heater and/or high-frequency generator.

Generally, a high-frequency heating device, e.g., a microwave oven, has an outer case and an inner case disposed within the outer case, which cases are substantially box-like in shape; the inner case defining a heating chamber. On the front face of the outer case, a door is provided for access to the heating chamber. An operating section including a display panel and various operating buttons is mounted on a panel to the right side of the door. Further, upper and lower electric heaters are disposed within the heating chamber. Each heater has a heat generating portion located in the heating chamber and a pair of connecting end portions attached to a rear plate of the inner case. Each connecting end portion protrudes to the rear of the inner case through an attachment hole provided in the rear plate. Outside of the right side plate of the inner case, a heat shielding plate is positioned at a predetermined distance from the right side plate. A receiving chamber is defined between the heat shielding plate and a right side wall of the outer case. The heat shielding plate prevents the heat existing at the side of the heating chamber from being radiated directly into the receiving chamber.

Within the receiving chamber, high voltage electric components for the high frequency generator are disposed. These components include a high voltage transformer, capacitor, rectifier, etc., as well as a magnetron (high frequency oscillator) for radiating high frequency energy into the heating chamber. Within the receiving chamber, there are also disposed a fan for cooling the high voltage electric components; and various controlling electric parts, such as a relay, printed circuit board, for controlling the operation of the high voltage electric components, fan, heater, etc.

Known microwave ovens with the general construction discussed above have the following operational drawbacks.

The temperature of the heat generating portion is higher than that of the connecting end portions. For this reason, in cooking, the left and right side plates; which, among the side plates of the inner case, are most closely adjacent to the heater, are likely to be heated to the highest degree. In addition, the heat radiated from the heating chamber is most intense in the vicinity of the right and left side plates. Thus, the gap defined between the right side plate and the shielding plate is made considerably large so as to enhance the effect of shielding the receiving chamber from the heat being radiated from the right side plate. In this case, however, the microwave oven as a whole becomes relatively bulky. One proposal to deal with this problem involves inserting whereby a heat insulating member is inserted between the right side plate and the heat shielding plate, to thereby increase the heat insulating effect, or utilizing high heat resistance electrical components within the receiving chamber. In either proposal, however, the cost is prohibitive.

For the purpose of avoiding the antenna effect of the lower heater when the magnetron operates, a microwave energy absorber such as, e.g., ferrite, should be provided around the connecting end portion rearwardly protruded from the rear plate of the inner case. To accommodate this energy absorber, a relatively large space for receiving the connecting end portions must be provided at the rear side of the inner case. This results in a larger oven requiring more installation space that is desirable.

Further, since a number of electrical components are received within the receiving chamber, the wiring operation between the high voltage electrical components and the controlling electrical components is difficult to perform when the device is assembled, and the maintenance and inspection thereof also become troublesome.

Since the high voltage electrical components, such as the high voltage transformer, which undergo the application of a voltage as high as approximately 2,000 V and generate heat which is relatively large in magnitude; and the controlling electrical components, which only undergo the application of a voltage as low as approximately 100 V and generate heat which is comparatively small in magnitude, are disposed within the same receiving chamber, it is likely that heat generation, leakage of the magnetic field, etc., by the high voltage transformer, magnetron, etc., respectively, will influence the controlling electric components. For this reason, it is possible that the controlling electrical components will perform erroneous operations and, at the same time, will cause a decrease in the durability of the microwave oven.

SUMMARY OF THE INVENTION

It is accordingly an object of the present invention to provide a high frequency heating device which is small in size. It is another object of the invention to provide a high frequency heating device in which wiring operation of the electric components is easily performed at the time of assembling of the device. It is yet another object of the invention to provide a high frequency heating device which is easily maintained and inspected. It is a further object of the invention to provide a high frequency heating device which is designed to prevent adverse effects on electrical components causing them to perform improperly thereby improving durability.

According to an aspect of the present invention, there is provided a high frequency heating device comprising an outer case which is substantially a boxlike shape; an inner case which is substantially a boxlike shape and is disposed within the outer case so as to be spaced at a prescribed interval from an inner face thereof, the inner case defining a heating chamber for receiving foodstuffs to be cooked therein, and having an access opening through which foodstuffs are put into and taken out of the inner case and a plurality of side plates respectively opposed to the inner face of the outer case; a heat shielding plate disposed in the interior of the outer case and an the exterior of one side plate of the inner case, in such a manner that the heat shielding plate is spaced at a prescribed space interval from and opposite the one side plate, the heat shielding plate being attached to the inner face of the outer case and dividing the space between the inner and outer cases into a first receiving chamber located at the side opposite to that at which the inner case is diposed with respect to the heat shielding plate serving as a boundary, and a second receiving chamber located at the side of the inner case; an electric heater disposed within the heating chamber, the heater having a heat generating portion located within the heating chamber and connecting end portions attached to the one side plate of the inner case and passing through this one side plate and the heat shielding plate to protrude into the first receiving chamber; a high frequency oscillator disposed within the first receiving chamber to radiate the high frequency energy into the heating chamber; and a controlling device disposed within the second receiving chamber to control the operations of the high frequency oscillator and heater.

According to the invention, the space between the outer case and the inner case is divided into first and second receiving chambers, the first receiving chamber having disposed therein the high frequency oscillator such as a magnetron, high voltage transformer, etc.; and the second receiving chamber having disposed therein the controlling device such as a relay, printed board, etc. Since, in this way, the high frequency oscillator and the controlling device are disposed in separate receiving chambers, it is possible to easily carry out the wiring operation at the time of assembling of the heating device and it is easier to inspect and maintain the device more, easily. Since the controlling device may be adversely affected by heat generation, leakage of magnetic field, etc. of the high frequency oscillator, the present invention makes it is possible to prevent the controlling device from malfunctioning thereby increasing the durability of the heating device.

Further, the heat shielding plate is provided at the outside of the side plate of the inner case to which the connecting end portions of the heater are attached, i.e., at the outside of the side plate which is relatively difficult to heat by the heater. For this reason, even when the space interval between the heat shielding plate and the side plate is made small, the heat shielding plate can serve effectively to shield the heat transmitted from the heating chamber. Accordingly, it is possible to miniaturize the heating device as a whole. The connecting end portions of the heater are received within the first receiving chamber. Therefore, there is no need to provide a special receiving space for receiving the connecting end portions, thereby allowing the heating device of the present invention to be made smaller in size.

BRIEF DESCRIPTION OF THE DRAWINGS

FIGS. 1 to 6 show a high frequency heating device according to an embodiment of the present invention, in which FIG. 1 is a perspective view showing an outer appearance of the device;

FIG. 2 is a sectional view taken along the line II—II of FIG. 1;

FIG. 3 is a sectional view taken along the line III—III of FIG. 2;

FIG. 4 is a sectional view taken along the line IV—IV of FIG. 2;

FIG. 5 is a perspective view schematically showing a state wherein a heat shielding plate is mounted;

FIG. 6 is a perspective view schematically showing an essential part of the device.

DETAILED DESCRIPTION OF THE PREFERRED EMBODIMENTS

An embodiment of the present invention will now be described in detail with reference to the accompanying drawings.

Figure 1:
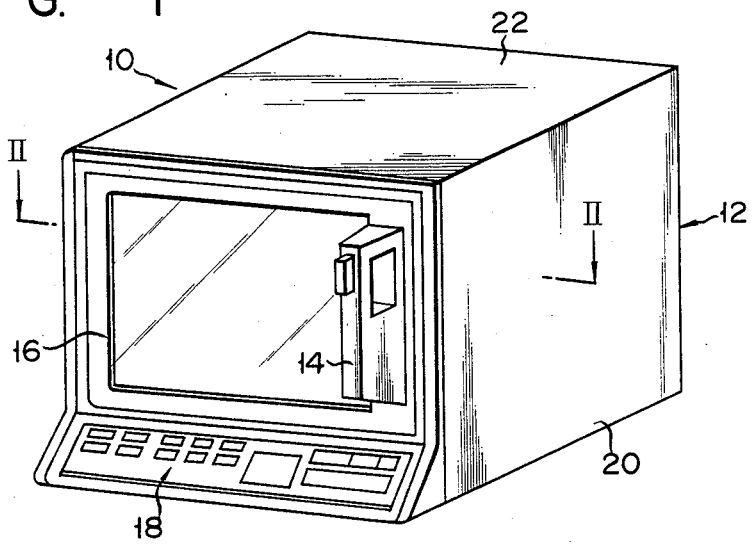
Figure 2:
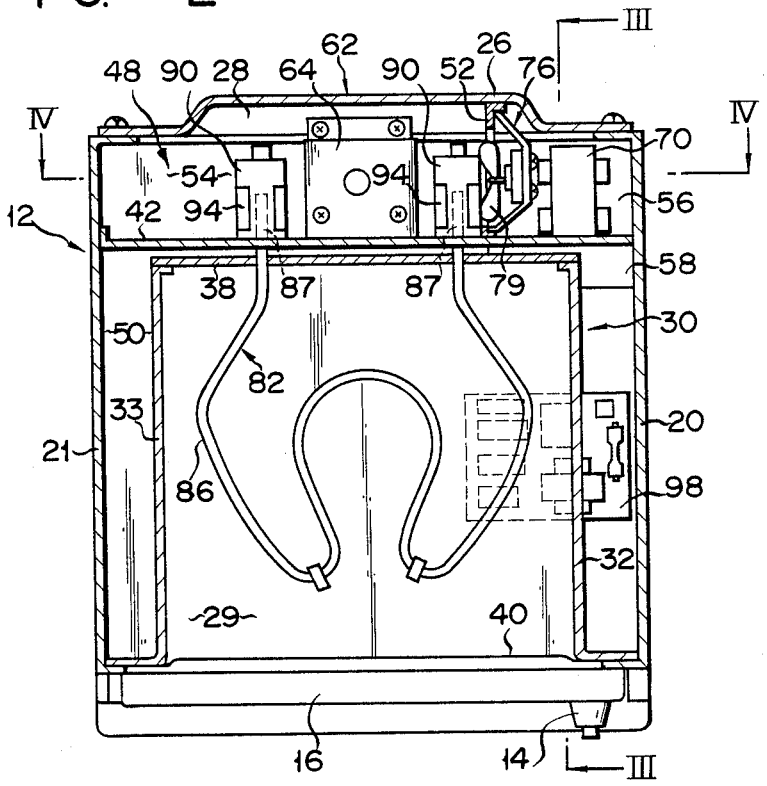
Figure 3:
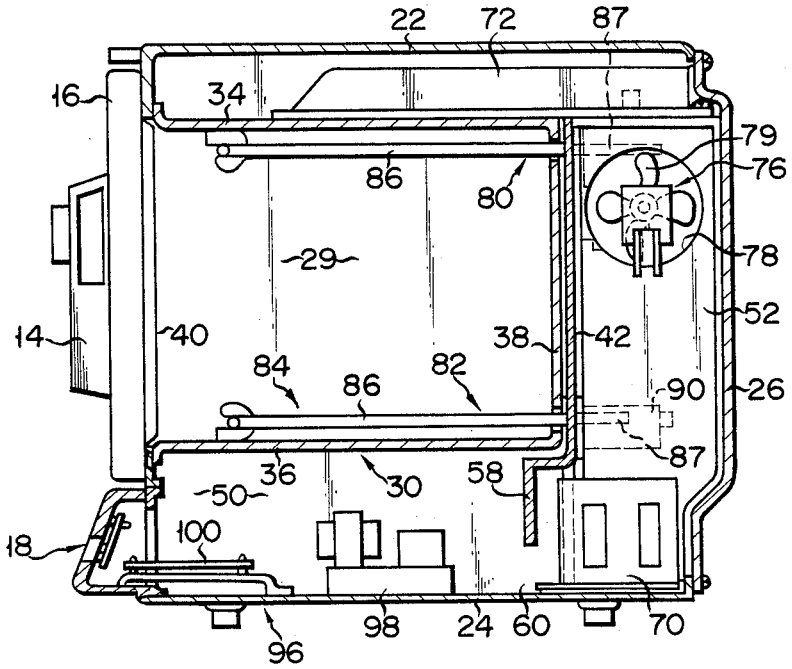

FIG. 1 shows a high frequency heating device, e.g., a microwave oven 10. This oven 10 has an outer case 12 which is substantially a box-like shape and a door 16 having a handle 14 which is pivotably attached to a front face of the outer case 12. Below the door 16, an operating section 18 having a display panel, various operating buttons, etc., is provided.

As shown in FIGS. 2 through 6, the outer case 12 has a pair of mutually opposed side walls 20, 21, a top wall 22 and a bottom wall 24, each of which is rectangular. Further, the outer case 12 has a rear wall 26 removably attached thereto, which wall has a recessed portion 28 protruding to the rear thereof. Forward end portions (.e., the lower end portions in FIG. 2) of the side walls 20, 21, top wall 22 and bottom wall 24 are each inwardly bent to form a flange, with the door 16 being attached to this flange. Within the outer case 12, is disposed an inner case 30 which is substantially a box-like in shape and defines a heating chamber 29 for receiving foodstuffs to be cooked therein. The inner case 30 has a pair of side plates 32, 33, a top plate 34, a bottom plate 36 and a rear plate 38, each of which is rectangular in shape. The respective forward end portions (i.e., the lower end portions in FIG. 2) of these plates 32 to 36 are each outwardly bent and fixed to the flange of the outer case 12. An access opening 40 for permitting foodstuffs to be put into and taken out of the heating chamber 29 therethrough is defined by the forward end edge of each plate and, this opening 40 is opened and closed by the door 16. The plates 32 to 36 of the inner case are opposed to the walls 20 to 26 of the outer case 12, respectively, in such a manner that they are spaced at prescribed intervals from the walls 20 to 26, respectively.

Figure 4:
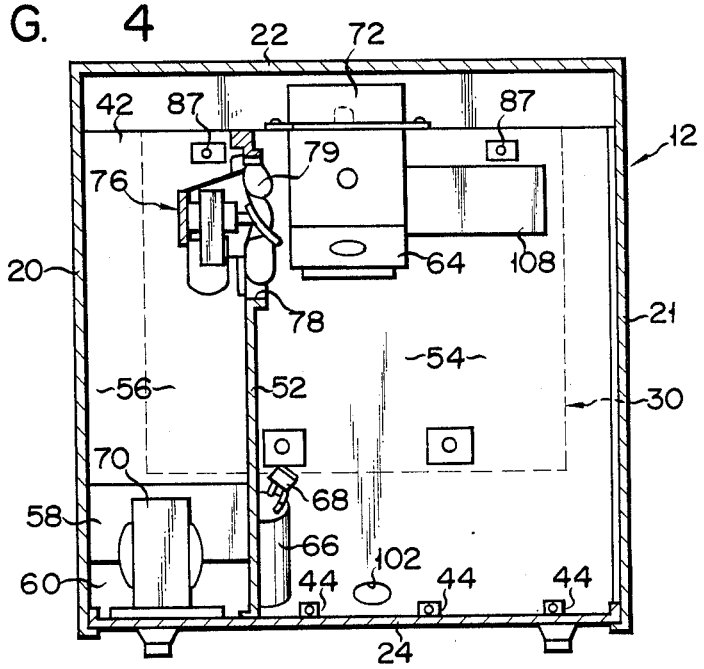
Figure 5:
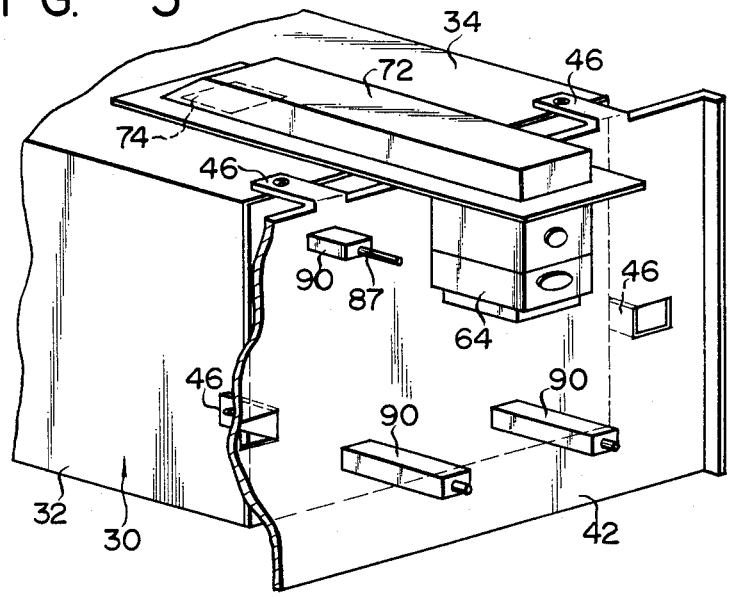
Figure 6:
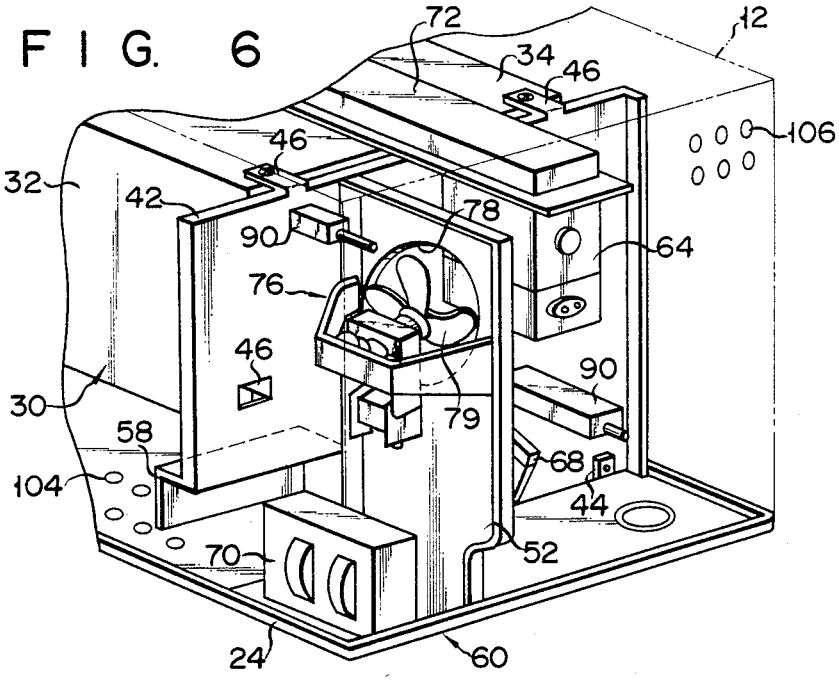

At the position which is inside the outer case 12 and to the rear of the rear plate 38 of the inner case 30, a heat shielding plate 42 is disposed so that it is spaced at a prescribed interval from the rear plate 38 and is made substantially parallel to the same. The heat shielding plate 42 takes the form of a substantial rectangle and has its lower edge and side edges abutting against the bottom wall 24 and side walls 20, 21, respectively. The heat shielding plate 42 is fixed, by screwing, to bent pieces 44 formed by cutting and raising portions of the bottom wall 24, as seen in FIGS. 4 and 6. The heat shielding plate 42 has a plurality of bent pieces 46 bent toward the inner case 30 and, a rear portion of the inner case 30 is fixed, by screws, to these bent pieces 46 so that the rear part of the inner case 30 is supported by the heat shielding plate 42. A space between the inner face of the outer case 12 and the outer face of the inner case 30 is divided, by means of the heat shielding plate 42 as a boundary, into a first receiving chamber 48 located at the side of the rear wall 26 and a second receiving chamber 50 located at the side of the inner case 30. It should be noted that the heat shielding plate 42 serves to prevent the heat within the heating chamber 29 from being radiated to the side of the first receiving chamber 48.

At a substantially central portion of the first receiving chamber 48, a partitioning plate 52 is disposed, which plate divides the interior of the first receiving chamber 48 into a third receiving chamber 54 and a fourth receiving chamber 56. This partitioning plate 52 is disposed substantially perpendicularly to the heat shielding plate 42 and has one of its sides attached to the same. Further, the other side and lower end of the partitioning plate 52 are screwed to the rear wall 26 and bottom wall 24 of the outer case 12, respectively. The partitioning plate 52 not only divides the first receiving chamber 48, but also serves as a reinforcing member for the outer case 12. As will be better seen in FIGS. 4 and 6, a leftward and lower end portion of the heat shielding plate 42 is bent toward the inner case, thereby forming a water leakage preventive portion 58 whose cross section is shaped like a capital "L". Beneath this water leakage preventive portion 58 is formed a communication opening 60 which permits communication between the second receiving chamber 50 and the fourth receiving chamber 56.

Within the first receiving chamber 48 is disposed a high frequency oscillator 62 for radiating high frequency energy into the heating chamber 29. This high frequency oscillator 12 includes a magnetron 64 (high frequency oscillator) disposed in the third receiving chamber 54, capacitor 66, a rectifier 68, and a high voltage transformer 70 disposed in the fourth receiving chamber 56. The magnetron 64 is fixed to a base end portion of a waveguide 72 mounted on the top plate 34. The high frequency energy supplied from the magnetron 64 are guided through the waveguide 72 and are introduced into the heating chamber 29 through a radiation opening 74 formed in the top plate 34. The capacitor 66 and rectifier 68 are mounted on the partitioning plate 52. The high voltage transformer 70 is disposed on the bottom wall 24 of the outer case 12. More specifically, this transformer 70 is disposed at a corner defined by the side wall 20 and rear wall 26 in such a manner as to oppose the communication opening 60. A cooling fan motor assembly 76 is disposed within the fourth receiving chamber 56, and mounted on the partitioning plate 52. A fan 79 of the assembly 76 is rotatably provided in a through bore 78 formed in this partitioning plate 52. This bore 78 permits communication between the third receiving chamber 54 and the fourth receiving chamber 56 and, at the same time, is so located as to oppose the magnetron 64.

Within the heating chamber 29, are disposed an upper electric heater 80 and a lower electric heater 82. The upper and lower heaters 80, 82 have a heat generating portion 86 located inside the heating chamber 29 and a pair of connecting end portions 87, respectively. These connecting end portions 87 are extended into the first receiving chamber 48 through the rear plate 38 of the inner case 30 and the heat shielding plate 42 and are removably held in heater fittings 90 which are secured to the heat shielding plate 42. Around each heater fitting 90, a microwave energy absorber 94, such as ferrite, is mounted.

Within the second receiving chamber 50, there is disposed a controlling device 96 for controlling the operations of the high frequency oscillator 62, cooling fan 76 and heaters 80, 82. The controlling device 96 is located at the position which is inward of the operating section 18 and is on the bottom wall 24. The controlling device 96 has controlling electric components 98 such as a relay, and a printed circuit board 100. The components 98 and board 100 are mounted on the bottom wall 24. Respective lead wires of the electric components parts 98 and printed circuit board 100 are guided into the first receiving chamber 48 through a bore 102 formed at the lower part of the heat shielding plate 42 and are connected to other electric components disposed within the first receiving chamber 48.

A number of ventilation apertures 104 are formed in the bottom wall 24 of the outer case 12, permitting communication between the exterior of the same and the second receiving chamber 50. They are located in the vicinity of the communication opening 60. As seen in FIG. 6, the rear wall 26 of the outer case 12 is formed with a number of discharge apertures 106 permitting communication between the exterior of the outer case 12 and the third receiving chamber 54. When the cooling fan 76 is driven, the cooling air (i.e., the open air) is sucked into the second receiving chamber 50 from the ventilation apertures 104, and is introduced into the fourth receiving chamber 56 through the communication opening 60. Thereafter, the cooling air is allowed to cool the high voltage transformer 70 and is then introduced into the third receiving chamber 54 through the bore 78, and is then blown onto the magnetron 64. Part of the cooling air blown onto the magnetron 64 is introduced into the heating chamber 29 through a duct 108 (see FIG. 4), while the remainder thereof is discharged to the exterior of the outer case 12 through the discharge apertures 106.

As mentioned above, the rear wall 26 is removably mounted and, part of the electric components within the first receiving chamber 48 are received in the recessed portion 28 of that rear wall 26. For this reason, when the rear wall 26 is dismounted from the outer case 12, part of the electric components within the first receiving chamber 48 are exposed on the exterior of the outer case.

The microwave oven 10 having the foregoing construction has the following advantages.

(1) The connecting end portions 87 of the heaters 80, 82 are mounted on the rear plate 38 of the inner case 30. Of all the plates of the inner case 30, the rear plate has the lowest heating temperature when cooking is conducted by the heaters 80, 82. Therefore, the amount of heat radiated outwardly from the inner case 30 defining the heating chamber 29 is the smallest at the rear plate 38. The heat shielding plate 42 is provided rearwardly of the rear plate 38 permitting a radiation thereonto of the smallest amount of heat. For this reason, even when the space interval between the rear plate 38 and the heat shielding plate 42 is made small as compared with that in the prior art case, the heat shielding plate 42 can sufficiently shield the transmission of the heat radiated from the inner case 30. Consequently, it is possible to miniaturize the device as a whole. Since the radiation of heat can be effectively shielded by the heat shielding plate 42, there is no need either to provide a heat insulating member between the rear plate 38 and the heat shielding plate 42 or to use expensive electric components of high heat resistance as the electric components within the first receiving chamber 48. Accordingly, a reduction in the manufacturing cost can be achieved. In addition, it is possible reliably to prevent thermal damage to the electric components disposed within the first receiving chamber 48, thereby enabling a remarkable enhancement of the durability of the various electric components, as compared to the prior art microwave oven.

(2) The connecting end portions 87 of the heaters 80, 82 and the heater fittings 90 are disposed within the first receiving chamber 48. For this reason, there is no longer any need to provide a special receiving chamber for receiving the connecting end portions 87 and the heater fittings 90, so that it is not only possible to further miniaturize the entire microwave even but to reduce the size of the space for installing the device, as well.

(3) The space between the outer case 12 and the inner case 30 is divided by the heat shielding plate 42 into the first receiving chamber 48 and the second receiving chamber 50. The high frequency oscillator 62 generating a large amount of heat is disposed within the first receiving chamber 48 while the controlling device 96 generating only a small amount of heat is disposed within the second receiving chamber 50. Therefore, it is possible to carry out the wiring operation between the high frequency oscillator 62 and the controlling device 96 more easily than in the conventional microwave oven and, at the same time, to facilitate the operations for maintenance and inspection of the device.

(4) The rear wall 26 of the outer case 12 is removably mounted thereto, arrangement thus being made such that by dismounting the rear wall 26, part of the electric components within the first receiving chamber 48 is exposed to the open air. Therefore, it is possible more easily to carry out the operations for maintenance and inspection of the electric components within the first receiving chamber 48. Since the high frequency oscillator 62 and the controlling device 96 are disposed within the separate receiving chambers partitioned by the heat shielding plate 42, respectively, the controlling device 96 is almost unaffected by the heat generated by and the magnetic field leaked from the high frequency oscillator 62. Accordingly, it is possible to prevent the controlling device 96 from making errors, as well as to prevent the same from undergoing a decrease in durability.

(5) The partitioning plate 52 is disposed within the first receiving chamber 48, and divides this receiving chamber 48 into third and fourth receiving chambers 54, 56. The partitioning plate 52 constitutes a substantially H-shaped frame, together with the rear wall 26 of the outer case 12 and the heat shielding plate 42, thereby reinforcing the mechanical strength of the microwave oven 10. The rear portion of the inner case 30 is supported by the heat shielding plate 42. For this reason, even when the inner case 30 sustains an impact from the front and back sides, at the time of opening and closing the door 16, neither the inner case 30 or the outer case 12 may be deformed. Moreover, the possibility is further lessened in that, at the time of opening and closing the door, a lock switch (not shown) interlocked with the same makes its erroneous operation. Since the partitioning plate 52 is disposed substantially at the central part of the first receiving chamber 48, the force acting upon the inner case 30 from the front and back sides thereof is applied thereto in such a manner that it is made substantially uniform at the right and left side thereof. Accordingly, even when the forward and backward forces are applied to the inner case 30, or even when the inner case is thermally expanded, it is impossible that the inner case 30 is deformed rightwards or leftwards into a non-uniform state, whereby it is possible to prevent the inner case 30 from being damaged and at the same time to prevent the high frequency energy within the heating chamber 29 from being leaked exteriorly. Such arrangement provides an increased mechanical strength of the rear part of the inner case 30, with the result that it is possible to reduce the degree of deforming the bottom wall 24 of the outer case 12 against the vibrations made during the transportation of the device 10 as well as against the impact applied when the device 10 drops down. Thus, the high voltage transformer 70 can be protected from breakage or damage.

(6) Since the interior of the first receiving chamber 48 is partitioned by the partitioning plate 52 into third and fourth receiving chambers 54, 56, the cooling air introduced by the cooling fan 76 into the third receiving chamber 54, via the through bore 78, can be reliably prevented from flowing in reverse from the third receiving chamber 54 into the fourth receiving chamber 56. For this reason, the cooling air is smoothly introduced into the fourth receiving chamber 56, thereby causing a remarkable increase in the efficiency with which the high voltage transformer 70 is cooled. The cooling air sent out of the through bore 78 is for the most part blown onto the magnetron 64, so that the magnetron 64 is cooled effectively. The side wall of the outer case 12 is not provided with vent holes such as that provided in the conventional microwave oven. Thus, the microwave oven 10 can be installed in a state wherein the side wall of the outer case 12 is cohered to, e.g., a wall. As a result, it is possible to reduce the size of the space for installing the device 10, more so than in the prior art microwave oven.

Figure 7:
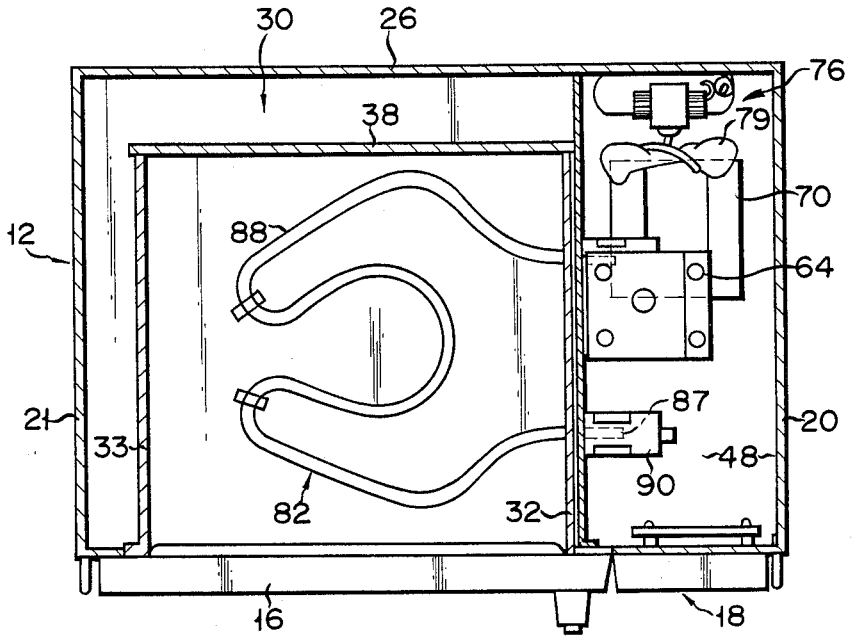
FIG. 7 is a plan view, partly broken away, of a high frequency heating device according to another embodiment of the present invention.

The present invention is not limited to the abovementioned embodiment, since various modifications may be made without departing from its spirit and scope. For instance, the oven range may be so arranged that the operating section 18 is provided upwardly of the door 16, while the controlling device 96 is disposed on the inner case 30 through an insulating material member. Further, the device 10 may be so arranged that, as shown in FIG. 7, the heat shielding plate 42 is provided outside of the right side plate 32 of the inner case 30, thereby defining the first receiving chamber 48 between the heat shielding plate 42 and the right side wall 20 of the outer case 12, and that the connecting end portions 87 of the heaters 80, 82 are mounted on the right side plate 32. In such a case, it is possible to make the space interval between the right side plate 32 and the heat shielding plate 42 smaller, as in the preceding embodiment; and, at the same time, to permit the connecting end portions 87 and the heater fittings 90 to be received within the first receiving chamber 48. Consequently, the device 10 can be made more compact.

What is claimed is:

1. A high frequency heating device comprising:

an outer case having a substantially box-like shape;

an inner case having a substantially box-like shape and which is disposed within said outer case so as to be spaced at a prescribed interval from an inner face thereof, said inner case defining a heating chamber for receiving foodstuffs to be cooked therein, and having an access opening through which said foodstuffs are put into and taken out of said inner case and a plurality of side plates opposed to respective inner faces of said outer case;

a heat shielding plate disposed between said inner and outer cases and fixed to an inner face of said outer case for dividing the space between said inner and outer cases into a first receiving chamber defined by said plate and a portion of said outer case and a second receiving chamber defined by portions of said plate, said inner case and said outer case;

electric heating means, disposed within said heating chamber, for providing heat within said heating chamber, said heating means having a heat generating portion located within said heating chamber and connecting end portions attached to said one side plate and passed through said one side plate and said heat shielding plate to protrude into said first receiving chamber;

high frequency oscillator means for radiating the high frequency energy into the heating chamber, being disposed within said first receiving chamber; and controlling means for controlling the operations of said high frequency oscillator means and said heater means, being disposed within said second receiving chamber.

2. A device according to claim 1, wherein said outer case has a pair of mutually opposed side walls, a bottom wall, a top wall, a rear wall, and a door rockably attached to oppose said rear wall; said inner case has a pair of mutually opposed side plates, a bottom plate, a top plate and a rear plate, said side plates, top plate and bottom plate having their forward end portions attached to said outer case; said access opening is defined by the respective forward end edges of said side plates, top plate and bottom plate, and is opened and closed by said door; and said heat shielding plate is disposed outside of said rear plate, substantially in parallel with the same.

3. A device according to claim 2, which further comprises a partitioning plate disposed within said first receiving chamber to partition said first receiving chamber into third and fourth receiving chambers, while serving to reinforce said outer case; said partitioning plate being provided perpendicularly to said heat shielding plate and having one side edge attached to said heat shielding plate, the other side edge attached to said rear wall and a lower side edge attached to said bottom wall; and wherein an end portion of said inner case located at the side of said rear plate is supported by said heat shielding plate.

4. A device according to claim 3, wherein said high frequency oscillator means includes a magnetron disposed within said third receiving chamber, and a high voltage transformer mounted on said bottom wall and within said fourth receiving chamber.

5. A device according to claim 4, which further comprises cooling means for cooling said high frequency oscillator means and said controlling means, said cooling means including a communication opening formed in said heat shielding plate to allow communication between said second receiving chamber and said fourth receiving chamber, and being located to oppose said high voltage transformer; a large number of ventilation apertures formed in said bottom wall to allow communication between the exterior of said outer case and said second receiving chamber, and being located in the vicinity of said communication opening; a through bore formed in said partitioning plate to allow communication between said third receiving chamber and said fourth receiving chamber; a large number of discharge apertures formed in said rear wall to allow communication between the exterior of said outer case and said third receiving chamber; and a cooling fan attached to said partitioning plate and disposed within said fourth receiving chamber to oppose said through bore, to introduce the open air into said third receiving chamber through; said ventilation apertures, said second receiving chamber, said communication opening, said fourth receiving chamber and said through bore and, then, to discharge the cooling air from said discharge apertures.

6. A device according to claim 5, wherein said through bore is formed to oppose said magnetron.

7. A device according to claim 4, wherein said rear wall of said outer case is removably mounted and has a recessed portion protruding outwardly from said outer case, said recessed portion having received therein a part of said high frequency oscillator means.

8. A device according to claim 3, wherein said partitioning plate is disposed substantially at the central portion of said first receiving chamber.

9. A device according to claim 2, wherein said controlling means is disposed on said bottom wall of said outer case.

10. A high frequency heating device comprising:

an outer case having a substantially box-like shape;

an inner case having a substantially box-like shape and which is disposed within said outer case so as to be spaced from an inner face of the inner case, said inner case defining a heating chamber for receiving foodstuffs to be cooked therein, and having an access opening through which foodstuffs are put into and taken out of said inner case;

a heat shielding plate disposed in the interior of said outer case and outside of a rear plate of said inner case, in such a manner that said heat shielding plate is spaced at a prescribed interval from and is opposed to the rear plate, said heat shielding plate being fixed to an inner face of said outer case, supporting the rear plate of the inner case and dividing the space between said inner and outer cases into a first receiving chamber located at the side opposite that at which said inner case is disposed, with respect to said heat shielding plate as a boundary, and a second receiving chamber located at the side of said inner case;

electric heating means disposed within said heating chamber, said heater means having a heat generating portion located within said heating chamber and connecting end portions attached to the rear plate and passed through the rear plate and said heat shielding plate to protrude into said first receiving chamber;

a partitioning plate disposed within said first receiving chamber so as to partition it into third and fourth receiving chambers, said partitioning plate being oriented perpendicularly to the heat shielding plate and being fixed to the heat shielding plate and the inner surface of the outer case, thereby reinforcing the inner and outer cases;

high frequency oscillator means, disposed within said first receiving chamber, for radiating high frequency energy into the heating chamber; and controlling means, disposed within said second receiving chamber, for controlling the operations of said high frequency oscillator means and said heater means.

11. A device according to claim 10, wherein said partitioning plate has one side edge attached to the heat shielding plate, the other side edge attached to a rear wall of the outer case and a lower side edge attached to a bottom wall of the outer case.

* * * * *